US007899353B2

(12) United States Patent
Barton et al.

(10) Patent No.: US 7,899,353 B2
(45) Date of Patent: Mar. 1, 2011

(54) METHOD AND APPARATUS FOR FUSING TONER ONTO A SUPPORT SHEET

(75) Inventors: Augusto E. Barton, Webster, NY (US); Anthony S. Condello, Webster, NY (US)

(73) Assignee: Xerox Corporation, Norwalk, CT (US)

( * ) Notice: Subject to any disclaimer, the term of this patent is extended or adjusted under 35 U.S.C. 154(b) by 433 days.

(21) Appl. No.: 12/101,515

(22) Filed: Apr. 11, 2008

(65) Prior Publication Data

US 2009/0257773 A1 Oct. 15, 2009

(51) Int. Cl.
*G03G 15/00* (2006.01)

(52) U.S. Cl. ..... 399/92

(58) Field of Classification Search ..... 399/92, 399/329, 328, 336, 335, 122, 320
See application file for complete search history.

(56) References Cited

U.S. PATENT DOCUMENTS 6,505,832 B2 1/2003 Moore et al.
6,608,987 B2 * 8/2003 Bartscher et al. ..... 399/336
6,754,457 B2 * 6/2004 Ciaschi et al. ..... 399/92
2008/0317528 A1 * 12/2008 Lee et al. ..... 399/335
2009/0185841 A1 * 7/2009 Izawa et al. ..... 399/335

FOREIGN PATENT DOCUMENTS

JP 09034283 A * 2/1997
JP 2003295648 A * 10/2003
JP 2004151475 A * 5/2004
JP 2004233768 A * 8/2004

* cited by examiner

*Primary Examiner*—Quana M Grainger
(74) *Attorney, Agent, or Firm*—Ronald E. Prass, Jr.; Prass LLP

(57) ABSTRACT

Fuser assemblies for fusing toner on support sheets, electrophotographic apparatuses, and methods of fusing toner on support sheets are disclosed. The fuser assembly includes a fuser belt; a thermally-insulated enclosure surrounding at least a portion of the fuser belt; a conveyor for conveying the support sheet to a nip at which the fuser belt contacts the support sheet and the toner is fused onto the support sheet; a pre-heater; and a heat transfer system for transferring heat from inside of the enclosure to the pre-heater, the pre-heater using the heat to pre-heat the support sheet before the support sheet is conveyed to the nip.

20 Claims, 5 Drawing Sheets

METHOD AND APPARATUS FOR FUSING TONER ONTO A SUPPORT SHEET

BACKGROUND

Fuser assemblies, electrophotographic apparatuses, and methods of fusing toner on support sheets in electrophotographic processes are disclosed.

In a typical electrophotographic printing process, a photoconductive member having a photoconductive layer is substantially uniformly charged. The photoconductive member is then exposed to selectively discharge areas of the photoconductive layer, while charge in other areas corresponding to image areas of an original document is maintained, so as to record an electrostatic latent image of an original document on the photoconductive layer. The latent image is then developed by depositing developer material including toner on the photoconductive layer. The developer material is attracted to the charged image areas to produce a visible toner image on the photoconductive layer. The toner image is then transferred from the photoconductive member to a support sheet.

To fuse (i.e., fix) the toner onto the support sheet, the toner is heated. The toner then cools and solidifies, resulting in the toner being bonded to the support sheet.

One process for the thermal fusing of toner onto support sheets involves passing a support sheet having a toner image thereon between rolls of a fuser with a nip between them. Belt fusers include a pressure roll, a fuser roll and a fuser belt positioned between the rolls. During operation, the support sheet with a toner image is passed to a nip between the rolls, and the pressure roll presses the support sheet onto the fuser roll. The fusing temperature for the toner image is controlled based on the temperature of the fuser belt.

It would be desirable to provide belt fusers that have a suitably long service life and are energy efficient.

SUMMARY

According to aspects of the embodiments, there are provided fuser assemblies for fusing toner on support sheets, electrophotographic apparatuses and methods of fusing toner on support sheets. Embodiments of the fuser assemblies include a fuser belt; a thermally-insulated enclosure surrounding at least a portion of the fuser belt; a conveyor for conveying the support sheet to a nip at which the fuser belt contacts the support sheet and the toner is fused onto the support sheet; a pre-heater; and a heat transfer system for transferring heat from inside of the enclosure to the pre-heater, the pre-heater using the heat to pre-heat the support sheet before the support sheet is conveyed to the nip.

DETAILED DESCRIPTION

Aspects of the embodiments disclosed herein relate to fuser assemblies, electrophotographic apparatuses including the fuser assemblies, and methods of fusing toner on support sheets using the fuser assemblies.

The disclosed embodiments include a fuser assembly for fusing toner onto a support sheet, which comprises a fuser belt; a thermally-insulated enclosure surrounding at least a portion of the fuser belt; a conveyor for conveying the support sheet to a nip at which the fuser belt contacts the support sheet and the toner is fused onto the support sheet; a pre-heater; and a heat transfer system for transferring heat from inside of the enclosure to the pre-heater, the pre-heater using the heat to pre-heat the support sheet before the support sheet is conveyed to the nip.

The disclosed embodiments further include a fuser assembly for fusing toner onto a support sheet, which comprises an endless fuser belt; a thermally-insulated enclosure surrounding at least a portion of the fuser belt; a conveyor including an endless conveyor belt for conveying the support sheet to a nip at which the fuser belt contacts the support sheet and the toner is fused onto the support sheet; a pre-heater; and an air circulation system for circulating hot air from inside of the enclosure to the pre-heater, wherein the pre-heater comprises a heat exchanger heated by the hot air circulated from the enclosure, the heat exchanger including a heating member for conductively heating the conveyor belt, which conductively pre-heats the support sheet before the support sheet is conveyed to the nip.

The disclosed embodiments further include a method of fusing toner onto a support sheet having toner thereon. The method comprises containing heat emanated by a fuser belt contained within a thermally-insulated enclosure at least partially surrounding the fuser belt; transferring heat from inside of the enclosure to a pre-heater; pre-heating a first support sheet supported on a conveyor with the pre-heater using heat transferred from the enclosure; and conveying the pre-heated first support sheet on the conveyor to a nip and fusing the toner onto the first support sheet.

Figure 1:
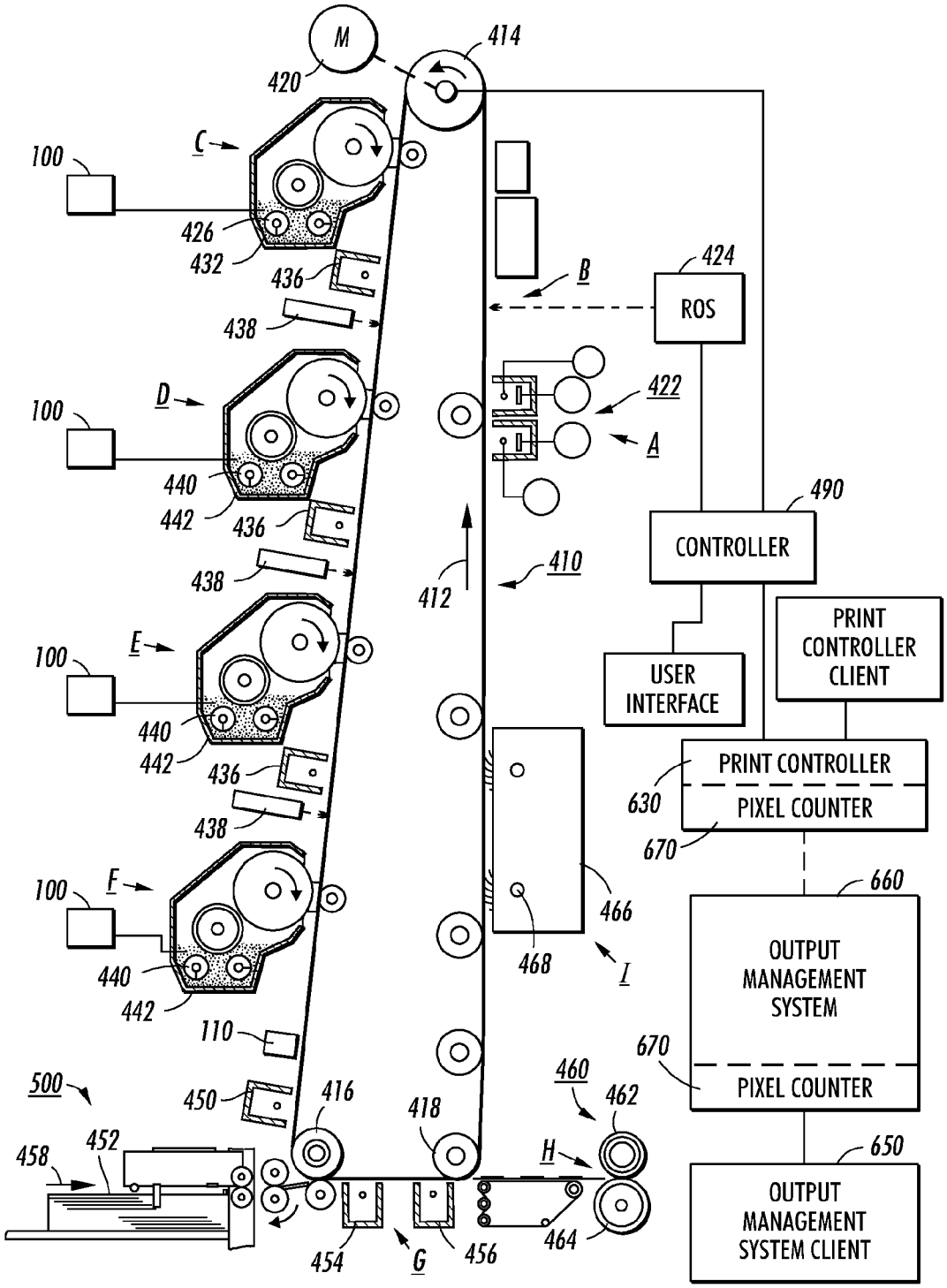
FIG. 1 PRIOR ART
FIG. 1 illustrates an embodiment of an electrophotographic apparatus.

FIG. 1 illustrates an exemplary electrophotographic apparatus (digital imaging system) in which embodiments of the disclosed fuser assembly can be used. Such digital imaging systems are disclosed in U.S. Pat. No. 6,505,832, which is hereby incorporated by reference in its entirety. The imaging system is used to produce an image, such as a color image output in a single pass of a photoreceptor belt. It will be understood, however, that embodiments of the fuser assemblies can be used in other imaging systems. Such systems include, e.g., multiple-pass color process systems, single or multiple pass highlight color system, or black and white printing systems.

As shown in FIG. 1, an output management system 660 can supply printing jobs to a print controller 630. Printing jobs can be submitted from the output management system client 650 to the output management system 660. A pixel counter 670 is incorporated into the output management system 660 to count the number of pixels to be imaged with toner on each sheet or page of the job, for each color. The pixel count information is stored in the output management system 660 memory. The output management system 660 submits job control information, including the pixel count data, and the printing job to the print controller 630. Job control information, including the pixel count data and digital image data are communicated from the print controller 630 to the controller 490.

The printing system can use a charge retentive surface in the form of an active matrix (AMAT) photoreceptor belt 410 supported for movement in the direction of arrow 412, for advancing sequentially through the various xerographic process stations. In the embodiment, the photoreceptor belt 410 is a continuous (endless) belt provided on a drive roll 414, tension roll 416 and fixed roll 418. The drive roll 414 is operatively connected to a drive motor 420 for moving the photoreceptor belt 410 sequentially through the xerographic stations.

During the printing process, a portion of the photoreceptor belt 410 passes through a charging station A including a corona generating device 422, which charges the photoconductive surface of photoreceptor belt 410 to a relatively high, substantially uniform potential.

Next, the charged portion of the photoconductive surface of the photoreceptor belt 410 is advanced through an imaging/exposure station B. At the imaging/exposure station B, a controller 490 receives image signals from the print controller 630 representing the desired output image, and processes these signals to convert them to signals transmitted to a laser-based output scanning device, which causes the charged surface to be discharged in accordance with the output from the scanning device. In the exemplary system, the scanning device is a laser raster output scanner (ROS) 424.

The photoreceptor belt 410, which is initially charged to a voltage $V_0$, undergoes dark decay to a level equal to about −500 volts. When exposed at the exposure station B, the photoreceptor belt 410 is discharged to a voltage level equal to about −50 volts. After exposure, the photoreceptor belt 410 contains a monopolar voltage profile of high and low voltages, with the high voltages corresponding to charged areas and the low voltages corresponding to discharged or developed areas.

At a first development station C, comprising a developer structure 432 utilizing a hybrid development system, a developer roll is powered by two developer fields. The first field is the AC field, which is used for toner cloud generation. The second field is the DC developer field which is used to control the amount of developed toner mass on the photoreceptor belt 410. The toner cloud causes charged toner particles to be attracted to the electrostatic latent image. Appropriate developer biasing is accomplished via a power supply. This type of system is a non-contact type in which only toner particles (black, for example) are attracted to the latent image and there is no mechanical contact between the photoreceptor belt 410 and a toner delivery device to disturb a previously developed, unfixed image. A toner concentration sensor 200 senses the toner concentration in the developer structure 432.

The developed image is then transported past a second charging device 436 where the photoreceptor belt 410 and developed toner image areas are recharged to a predetermined level.

A second exposure/imaging is performed by device 438 including a laser-based output structure, which selectively discharges the photoreceptor belt 410 on toned areas and/or bare areas, pursuant to the image to be developed with the second color toner. At this point of the process, the photoreceptor belt 410 contains toned and untoned areas at relatively high voltage levels, and toned and untoned areas at relatively low voltage levels. These low voltage areas represent image areas, which are developed using discharged area development (DAD). A negatively-charged, developer material 440 comprising color toner is employed. The toner, e.g., yellow toner, is contained in a developer housing structure 442 disposed at a second developer station D and is transferred to the latent images on the photoreceptor belt 410 using a second developer system. A power supply (not shown) electrically biases the developer structure to a level effective to develop the discharged image areas with negatively charged yellow toner particles. Further, a toner concentration sensor can be used to sense the toner concentration in the developer housing structure 442.

The above procedure is repeated for a third image for a third suitable color toner, such as magenta (station E), and for a fourth image and suitable color toner, such as cyan (station F). The exposure control scheme described below may be utilized for these subsequent imaging steps. In this manner, a full-color composite toner image is developed on the photoreceptor belt 410. In addition, a mass sensor 110 measures developed mass per unit area.

In case some toner charge is totally neutralized, or the polarity reversed, thereby causing the composite image developed on the photoreceptor belt 410 to consist of both positive and negative toner, a negative pre-transfer dicorotron member 450 is provided to condition the toner for transfer to a support sheet using positive corona discharge.

Subsequent to image development, a support sheet 452 (e.g., paper) is moved into contact with the toner images at transfer station G. The support sheet 452 is advanced to transfer station G by a sheet feeding apparatus 500. The support sheet 452 is then brought into contact with the photoconductive surface of photoreceptor belt 410 in a timed sequence so that the toner powder image developed on the photoreceptor belt 410 contacts the advancing support sheet 452 at the transfer station G.

The transfer station G includes a transfer dicorotron 454, which sprays positive ions onto the backside of the support sheet 452. The ions attract the negatively charged toner powder images from the photoreceptor belt 410 to the support sheet 452. A detack dicorotron 456 is provided for facilitating stripping of support sheets from the photoreceptor belt 410.

After transfer of the toner images, the support sheet continues to move, in the direction of arrow 458, onto a conveyor 600. The conveyor 600 advances the support sheet to a fusing station H. The fusing station H includes a fuser assembly 460 for permanently affixing the transferred powder image to the support sheet 452. The fuser assembly 460 comprises a heated fuser roll 462 and a pressure roll 464. The support sheet 452 passes between the fuser roll 462 and pressure roll 464 with the toner powder image contacting the fuser roll 462, causing the toner powder images to be permanently affixed to the support sheet 452. After fusing, a chute (not shown) guides the advancing support sheet 452 to a catch tray, stacker, finisher or other output device (not shown), for subsequent removal from the printing apparatus by the operator. The fuser assembly 460 can be contained within a cassette, and can include additional elements not shown in FIG. 1, such as a belt around the fuser roll 462.

After the support sheet 452 is separated from the photoconductive surface of the photoreceptor belt 410, residual toner particles carried by the non-image areas on the photoconductive surface are removed from the photoconductive surface. These toner particles are removed at cleaning station I using a cleaning brush structure contained in a housing 466.

The controller 490 is operable to regulate the various printer functions. The controller 490 can be a programmable controller operable to control printer functions described above.

Figure 2:
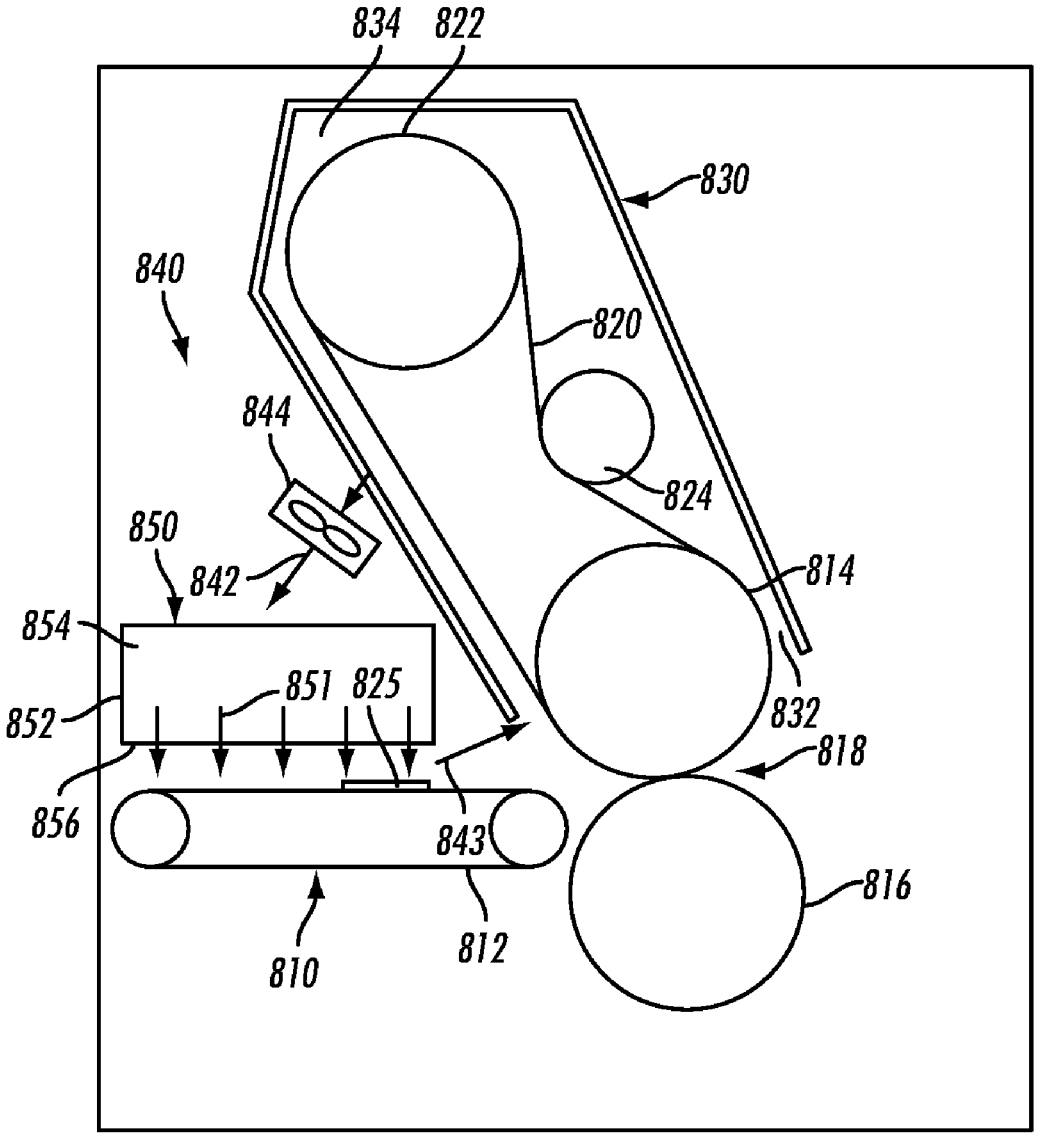
FIG. 2 illustrates an embodiment of a fuser assembly including a continuous fuser belt and a support sheet pre-heater.

FIG. 2 illustrates an exemplary embodiment of a fuser assembly 800 constructed to provide improved thermal efficiency in different types of electrophotographic apparatuses. For example, in the electrophotographic apparatus shown in FIG. 1, the fuser assembly 800 can be used in place of the fuser assembly 460 at station H.

The fuser assembly 800 further includes a conveyor 810 with an endless (continuous) conveyor belt 812. A fuser roll 814 and a pressure roll 816 are located near the downstream end of the conveyor belt 812. The fuser roll 814 and pressure roll 816 define a nip 818 between them. In the embodiment, an endless fuser belt 820 is provided on the fuser roll 814 and on a belt roll 822. A tensioning roll 824 is arranged to tension the fuser belt 820. The fuser belt 820 can be driven in the counter-clockwise direction by a stepper motor or the like (not shown).

The conveyor belt 812 is driven in the clock-wise direction by a motor (not shown) to convey a support sheet 825 with a toner image to the nip 818. At the nip 818, the fuser belt 820 contacts the support sheet 825 and sufficient heat and pressure are applied to fuse the toner on the support sheet 825. Typically, the fusing temperature used to fuse the toner on the support sheet at the nip 818 is in the range of about 180° C. to about 200° C. The glass transition temperature of toner is typically in the range of about 55° C. to about 65° C.

In the embodiment, the fuser belt 820 can be longer than a typical fuser belt. For example, the fuser belt 820 can have a length of at least about 350 mm, such as at least about 500 mm, 600 mm, 700 mm, 800 mm, 900 mm, 1000 mm, or even longer.

The primary failure modes of belt fusers, which represent the largest contribution to fuser run cost, are typically attributed to the life of the fuser belt. The fuser belt comes into contact with the toner during the fusing process, and largely influences the final quality of prints. The longer fuser belt 820 used in the fuser assembly 800 can provide a relatively longer service life than shorter belts because the longer fuser belt 820 has more total surface area available for wear.

The greater total exposed surface area of the longer fuser belt 820 causes it to emanate significant heat during fusing. Accordingly, it would be desirable to provide fuser assemblies that include longer fuser belts to utilize the advantage of increased belt service life (and thus also increased fuser assembly service life), without comprising thermal efficiency. The fuser assembly 800 is constructed to reclaim heat emanated by the longer fuser belt 820 so that this heat is not lost within the fuser assembly as waste heat.

Figure 3:
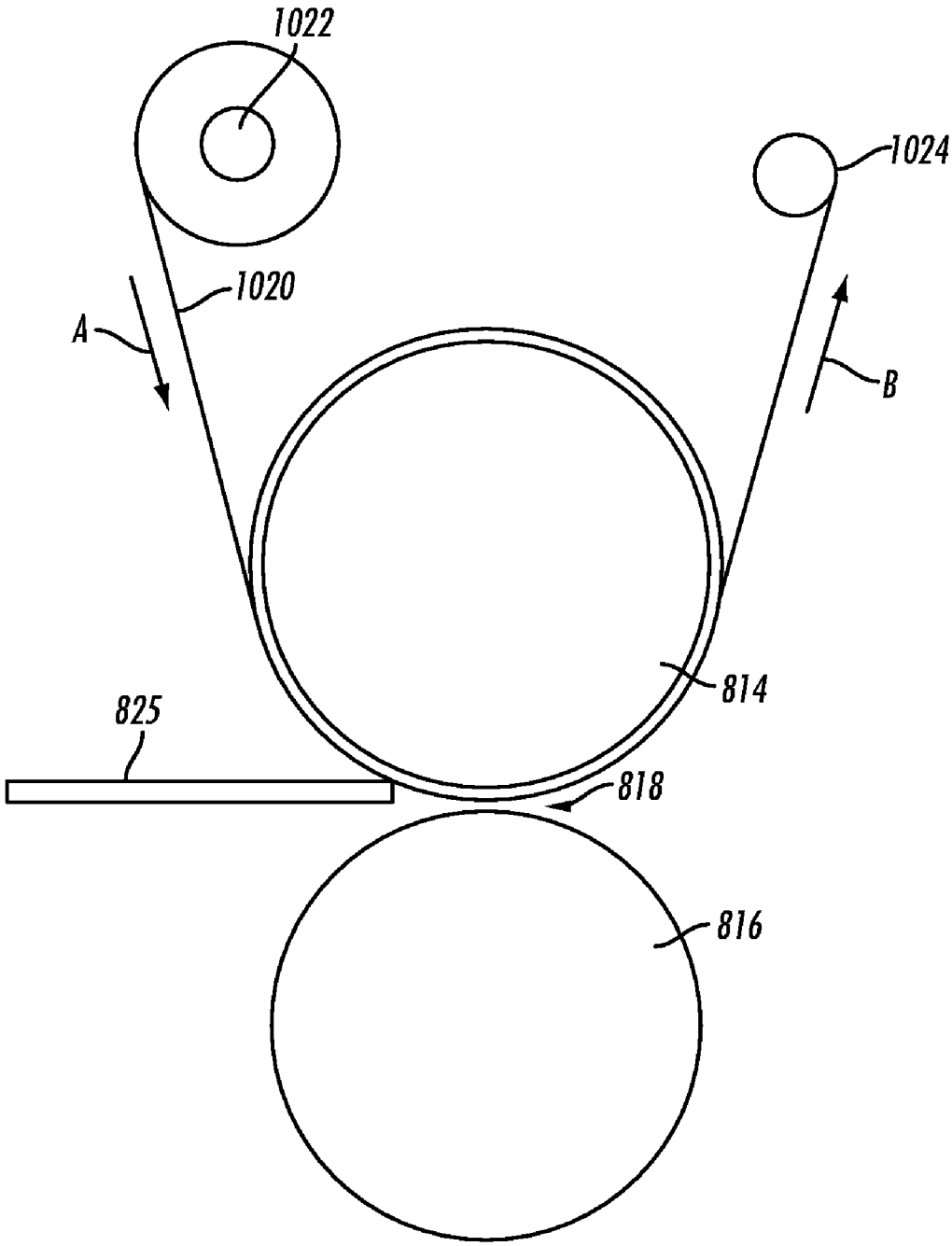
FIG. 3 illustrates a portion of an embodiment of a fuser assembly including a non-continuous fuser belt.

FIG. 3 depicts another embodiment of a fuser assembly including a non-continuous (i.e., non-endless) fuser belt 1020. During operation, the fuser belt 1020 is unspooled from the roll 1022 onto the roll 1024 as indicated by arrows A, B, and then unspooled from the roll 1024 onto the roll 1022 by rotation of the rolls 1022, 1024 in the reverse direction. A support sheet 825 is shown entering the nip 818 between the fuser roll 814 and the pressure roll 816. The fuser assembly including the fuser belt 1020 can be constructed to reclaim heat emanated by the fuser belt 1020.

As shown in FIG. 2, the fuser assembly 800 further includes a thermally-insulated enclosure 830. The enclosure 830 includes an open end 832 and an interior space 834. The enclosure 830 is constructed to confine heat emanated by the fuser belt 820, as well as by other components of the fuser assembly 800 that are enclosed by the enclosure 830, inside of the enclosure during operation of the fuser assembly 800. In the embodiment, the enclosure 830 is configured to surround at least a portion of the fuser belt 820, such as a significant portion of the fuser belt as shown in FIG. 2, and also surround a portion of the fuser roll 814. It is desirable that the enclosure 830 have a small size so that the volume of the space 834 for confining heat is small.

The enclosure 830 is comprised partially or entirely of at least one thermal insulator material. The thermal insulator material used to form the enclosure 830 can be any material having the desired thermal insulating properties and which is compatible for use within the environment of the fuser assembly 800. For example, the enclosure can be constructed entirely of at least one ceramic, polymeric (e.g., plastic) or composite material. In embodiments, these materials can be formed in the desired configuration of the enclosure 830 by a molding process, for example. Alternatively, the enclosure 830 can be made from two or more pieces of such materials, which are joined together using an adhesive, fasteners, or the like. In other embodiments, the enclosure can be made from at least one thermal insulator material and at least one other material that is not used for its thermal insulating properties. For example, a fiberglass material or like thermal insulator can be provided on a plastic, metallic or composite substrate. In other embodiments, a sheet of a thermal insulator material can be secured to a sheet of a metal or plastic to form a laminate structure. The enclosure 830 can be fixedly mounted in an electrophotographic apparatus in any suitable manner, such as by attachment to the mainframe.

The ability of the enclosure 830 to confine heat emanated by the fuser belt 820 and other components located within the space 834 can be increased by, for example, increasing the thickness of the thermal insulator material(s), using thermal insulator materials having a reduced thermal conductivity value (i.e., k value), and/or decreasing the size of the open end 832 of the enclosure 830 to control air flow into and out of the enclosure. By increasing the heat confinement efficiency of the enclosure 830, a greater percentage of the heat emanated from the fuser belt 820 and other components, which otherwise would be waste heat, can be reclaimed and used to preheat support sheets prior to fusing toner on the sheets using the fuser belt 820. By using this pre-heating, the temperature to which the fuser belt 820 needs to be heated in order to effectively fuse toner on support sheets using the fuser belt 820 can be reduced as compared to not reclaiming this heat. Consequently, the total amount of energy consumption by the fuser assembly 800 can be reduced by using pre-heating.

Heat emanated by the fuser belt 820 and other components inside of enclosure 830 heats the air within the enclosure to an elevated temperature. By thermally insulating the fuser belt 820 within the enclosure 830, the air temperature within the space 834 is increased relative to the air temperature (i.e., ambient air temperature) outside of the enclosure 830. The configuration of the enclosure 830 and the materials used to form the enclosure 830 can be selected to control the heat confinement efficiency of the enclosure 830, and thereby control the maximum air temperature that is reached within the space 834 during operation of the fuser assembly 800. The enclosure 830 can be constructed so that internal electrical components, such as sensors, electrical wiring and the like, are not exposed to temperatures that can cause heat-related damage to these components. For example, the enclosure can be constructed so that the maximum air temperature reached within the space 834 during operation of the fuser assembly 800 is about 120° C., 130° C., 140° C., or 150° C. A temperature sensor (not shown) can optionally be provided in the fuser assembly 800 to monitor the air temperature within the space 834, to ensure that the maximum air temperature is not exceeded.

In the embodiment, the fuser assembly 800 includes a heat transfer system 840 for transferring heat from the space 834 inside of the enclosure 830 to a pre-heater 850 for heating support sheets. The heat transfer system 840 includes an air-circulating system for circulating hot air from the enclosure 830 to the pre-heater 850. The air circulating system includes a flow passage 842 extending from the enclosure 830 to the pre-heater 850, and a blower 844 operable to circulate the hot air through the flow passage 842. The flow passage 842 is desirably thermally insulated to minimize cooling of the hot air within the flow passage. As indicated by arrow 843, the blower 844 also re-circulates ambient air into the enclosure 830 through the open end 832. In the space 834, this re-circulated air is heated by heat emanated by the fuser belt 820 and other components. This heated air is circulated to the pre-heater 850 through the flow passage 842 by operation of the blower 844.

As indicated by arrows 851, hot air supplied to the pre-heater 850 via the flow passage 842 is applied to the support sheet 825 being conveyed by the conveyor 810. The hot air pre-heats the support sheet 825 primarily by convection before the support sheet 825 reaches the nip 818, where it is subjected to sufficient heat and pressure via the fuser belt 820 and pressure roll 816 to fuse the toner onto the support sheet 825. In the fuser assembly 800, heat emanated by the fuser belt 820 and other components confined by the enclosure 830 is reclaimed and used as the primary heat source to pre-heat support sheets before fusing toner on the support sheets.

By pre-heating the support sheet 825 using the hot air distributed by the pre-heater 850, the amount of additional heat that needs to be supplied to the support sheet 825 at the nip 818 via the fuser belt 820 (and optionally the pressure roll 816) to effect fusing of the toner on the support sheet 825 can be reduced significantly as compared to not pre-heating the support sheet 825 prior to fusing. The amount of additional heat applied to the support sheet 825 at the nip 818 by the fuser belt 820 is controlled by the fuser temperature set-point. As the amount of energy that needs to be applied to the fuser roll 814 (and optionally also to the pressure roll 816) in order to heat the fuser belt 820 to a sufficiently-high temperature to fuse toner onto the support sheet 825 can be reduced in the fuser assembly 800, the fuser temperature set-point can be reduced. Accordingly, using the pre-heater 850 to pre-heat the support sheet 825 with the reclaimed heat from the enclosure 830 enhances the energy efficiency of the fuser assembly 800.

In the embodiment, the pre-heater 850 is positioned to distribute the hot air from the enclosure 830 directly onto the support sheet 825 being conveyed on the conveyor belt 812. The pre-heater 850 comprises a housing 852 defining a plenum 854. The housing 852 is desirably thermally insulated to minimize cooling of the hot air within the plenum 854. The pre-heater 850 also includes a porous member 856 positioned adjacent the conveyor 810 for distributing the hot air onto the support sheet 825 to pre-heat the support sheet. The porous member 856 can be located close to the conveyor belt 812 (e.g., within a distance of about 50 mm) to minimize cooling of the hot air reaching the support sheet 825.

It is desirable that the pre-heat temperature of the support sheet 825 be below the glass transition temperature for the toner on the support sheet. For example, for a duplex (two-sided) printing process, it is desirable to limit the maximum temperature to which the support sheet 825 is heated by the hot air typically to a temperature of about 60° C. to 70° C., in order to avoid fused toner being subject to image quality (IQ) defects on the support sheets. The pre-heat temperature of the support sheet 825 can be controlled by adjusting the flow of the hot air from the enclosure 830 to the pre-heater 850.

Figure 4:
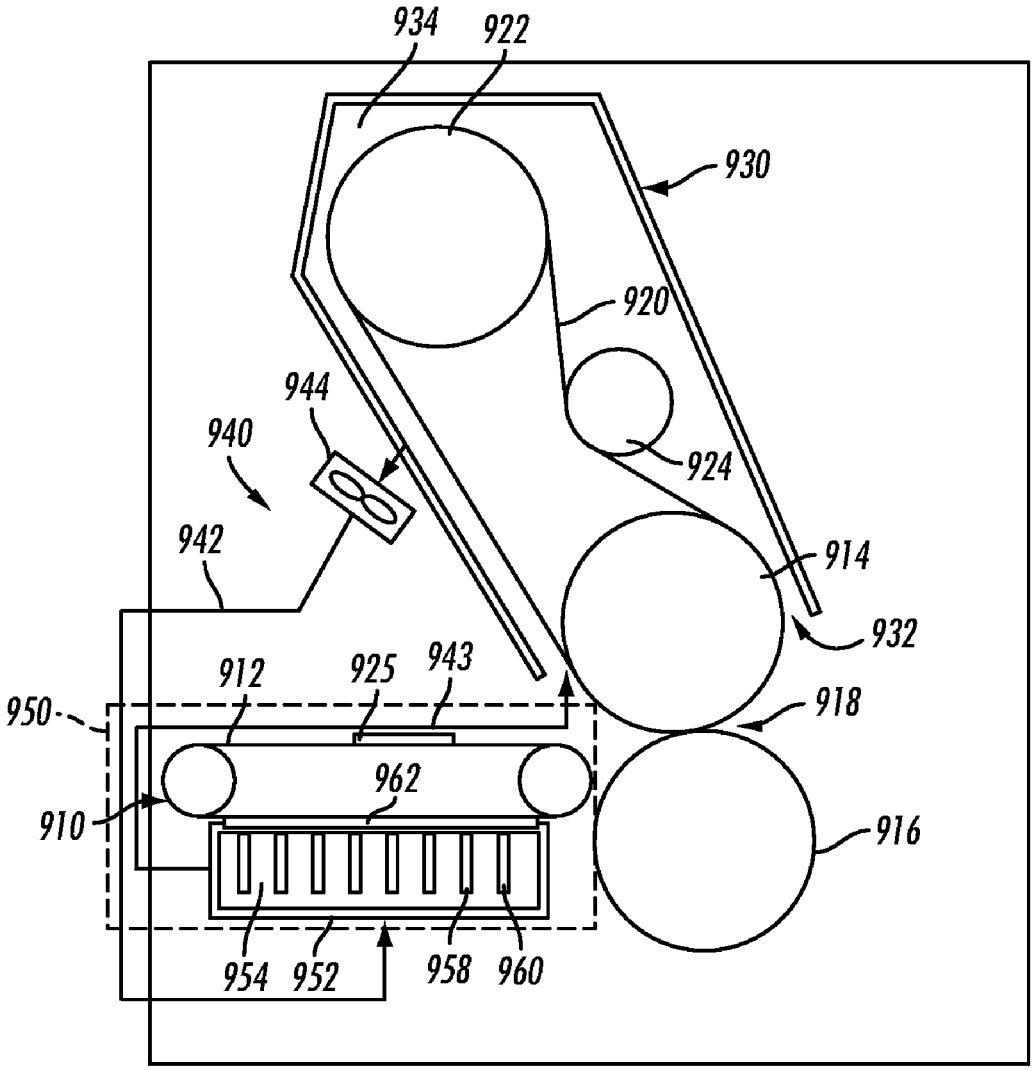
FIG. 4 illustrates another embodiment of a fuser assembly including a continuous fuser belt and a support sheet pre-heater.

FIG. 4 depicts a fuser assembly 900 according to another embodiment. In this embodiment, the fuser assembly 800 includes a fuser belt 920, fuser roll 914, pressure roll 916, roll 922, roll 924, enclosure 930 and conveyor 910 having a conveyor belt 912. These components can have the same structures as the corresponding components included in the fuser assembly 800.

As shown in FIG. 4, the enclosure 930 includes an open end 932 and an interior space 934. The enclosure 930 can surround at least a portion of the fuser belt 920 and the fuser roll 914, as shown.

The fuser assembly 900 includes a heat transfer system 940 with an air circulating system for circulating hot air from within the enclosure 930 to a pre-heater 950. In this embodiment, the air circulating system includes a flow passage 942 extending from the enclosure 930 to the pre-heater 950, and a blower 944. The flow passage 942 is desirably thermally insulated to minimize cooling of the hot air within the flow passage. The blower 944 is operable to circulate the hot air through the flow passage 942. As indicated by arrow 943, the blower 944 also re-circulates air from the pre-heater 950 to the open end 932 of the enclosure 930 via a flow passage 943. In the space 934, the re-circulated air is heated by heat emanated by the fuser belt 920 and other components, and this heated air is transported to the pre-heater 950 through the flow passage 942.

In the embodiment, the pre-heater 950 is constructed to directly heat the conveyor belt 912 by conduction, which, in turn, directly heats the support sheet 925 by conduction. In the illustrated configuration of the fuser assembly 900, the pre-heater 950 heats the bottom portion of the rotating conveyer belt 912. Heat is conducted from the conveyor belt 912 to the support sheet 925 supported on the top portion of the conveyor belt 912. Accordingly, the pre-heater 950 indirectly pre-heats the support sheet 925 before toner is fused onto the support sheet at the nip 918.

In the embodiment, the pre-heater 950 includes a housing 952 defining a space 954, and a heat exchanger 958. The heat exchanger 958 is heated by hot air circulated from the space 934 within the enclosure 950 to the space 954 within the housing 952 via the flow passage 942. The housing 952 can be thermally insulated to reduce cooling of the hot air in the space 954 to allow the heat exchanger 958 to be heated to a desirable temperature.

The heat exchanger 958 can heat the conveyor belt 912 to a desired temperature to effect pre-heating of support sheets. The temperature to which the conveyor belt 912 is heated by the heat exchanger 958 can be selected based on various factors including, for example, the thickness of the support sheet 925, the thermal conductivity of the support sheet 925, and the toner composition (and corresponding glass transition temperature and thermal conductivity). The enclosure 930, heat transfer system and pre-heater 950 are constructed to allow control of the temperature to which the heat exchanger 958 is heated by the hot air transferred from the enclosure 930. For example, the configuration and materials of the enclosure 930, the heat insulating characteristics of the flow passage 912 and pre-heater 950, the heat transfer characteristics of the heat exchanger 958, and the blower 944 can be selected to control heat transfer from the enclosure 930 to the pre-heater 950 and heating of the conveyor belt 912 by the pre-heater.

It is desirable that the pre-heat temperature of the support sheet 925 be less than the glass transition temperature for the toner. For example, for a duplex (two-sided) printing process, it is desirable to limit the maximum temperature to which the conveyor belt 912 is heated typically to a temperature of about 60° C. to 70° C. to avoid fused tuner being subject to image quality (IQ) defects on the support sheets. To avoid heating the support sheet 925 to a temperature above the glass transition temperature of the toner, the temperature of the conveyor belt 912 can be maintained no higher than slightly above the glass transition temperature of the toner.

In the embodiment, the heat exchanger 958 includes a plurality of fins 960 to provide a high effective surface area for convective heat transfer from the hot air. By increasing the effective surface area of the fins, the amount of air flow of the hot air needed to heat the fins 960 to a desired temperature can be decreased. The fins 960 are in thermal contact with a heating member 962, such as a metallic plate. The heating member 962 can have a width as large as that of the conveyor belt 912 to allow the metallic plate to directly heat the entire width of the conveyor belt 912.

The temperature of the conveyor belt 912 can be controlled by adjusting the flow of the hot air from the enclosure 930 to the pre-heater 950.

In an embodiment, the heating member 962 can be selectively movable toward and away from the conveyor belt 912 to control heating of the conveyor belt 912. This movement of the heating member 962 can be provided, for example, by a mechanism and a motor (not shown) operatively connected to the heating member 962. The motor can be controlled by a controller. The heating member 962 can be automatically moved into contact with the conveyor belt 912 to heat the conveyor belt 912, or moved away from the conveyor belt 912 to discontinue heating of the conveyor belt 912. The surface of the heating member 962 facing the conveyor belt 912 can optionally be coated with a thermally-conductive, lubricating substance, effective to reduce wear of the conveyor belt 912 caused by contact with the heating member 962. The lubricating substance that is used should be chemically compatible with the support sheets and toner.

The fuser assembly 900 can be used for fusing toner on support sheets having a range of thicknesses. During operation of an electrophotographic apparatus, a user may produce copies using support sheets all of the same thickness, or from support sheets having different thicknesses. For example, a user may make copies using support sheets having a first thickness and then make copies from support sheets having a greater second thickness. The amount of heat that needs to be supplied to thicker support sheets to fuse toner on the sheets generally is greater than the amount of heat that needs to be supplied to thinner support sheets of the same material to fuse the same toner composition on the thinner sheets. In order to heat thicker sheets to a sufficiently-high temperature to fuse toner on the sheets, the fuser assembly typically heats the fuser belt to a higher temperature than used for thinner support sheets in order to supply an increased amount of heat to the thicker support sheets to effect fusing of toner on the sheets.

Increasing the temperature of the fuser belt (i.e., the fuser temperature set point) during operation of the fuser assembly requires increasing the amount of heat supplied to the fuser belt. Heating the fuser belt from one set point to a higher set point can cause a time delay in the printing process. To reduce this time delay, the apparatus can be programmed to begin to increase the temperature set point of the fuser belt before thicker support sheets are printed. This approach may result in thinner support sheets being subjected to a higher fuser temperature set point than needed to fuse toner on the thinner sheets.

Embodiments of the disclosed fuser assemblies, such as the fuser assembly 900, can be used to fuse toner on both thinner and thicker sheets while keeping the temperature set point of the fuser belt 920 more uniform. For example, to fuse toner on thinner support sheets using the fuser assembly 900, the heating member 962 can be moved away from contact with the conveyor belt 912 so that the support sheet 925 is not subjected to pre-heating. The temperature set point of the fuser belt 920 can be selected such that the fuser belt 920 supplies sufficient heat to the thinner support sheet 925 in the nip 918 to fuse toner on the support sheet. When a thicker support sheet 925 is to be printed using the fuser assembly 900, the heating member 962 can be moved into contact with the conveyor belt 912 to effect pre-heating of the thicker support sheet 925 so that the fuser belt 920 supplies sufficient additional heat to the support sheet 925 in the nip 918 to fuse toner on the thicker support sheet. The heating member 962 can be used to heat the conveyor belt 912 to the desired temperature to pre-heat the thicker support sheet more quickly than heating the fuser belt 920 to a higher temperature set point. Due to the amount of heat needed to heat the fuser belt 920, which desirably has a longer length, to a higher set point, it can also be more energy efficient to pre-heat the support sheet 925 as compared to not pre-heating the support sheet 925, but instead increasing the temperature set point of the fuser belt 920. Accordingly, the fuser assembly 900 (and other embodiments of the disclosed fuser assemblies) can provide improved time and energy efficiency when used for printing thinner and thicker support sheets in the same apparatus.

Aspects of heat transfer that occurs in embodiments of the disclosed fuser assemblies can be estimated by thermal modeling. When the fuser belt of a fuser assembly is at an elevated temperature, $T_{belt}$, and exposed to ambient temperature, $T_{amb}$, the rate of heat loss from the belt, $\dot{Q}_{belt_loss}$, is:

$$\dot{Q}_{belt_loss}=\alpha_{amb}A_{belt}(T_{belt}-T_{amb}), \tag{1}$$

where $\alpha_{amb}$ is the convective heat transfer coefficient from the belt surface to the ambient environment.

The amount of heat, $\dot{Q}_{paper}$, that needs to be supplied to a sheet of paper (with toner on the paper) to heat the paper from ambient temperature to the fusing temperature for the toner, $T_{paper_out}$, is given by:

$$\dot{Q}_{paper}=\dot{m}_{paper}Cp_{paper}(\overline{T}_{paper_out}-T_{amb}), \tag{2}$$

where $\dot{m}_{paper}$ is the mass rate of the paper, $Cp_{paper}$ is the specific heat of the paper, and $\overline{T}_{paper_out}$ is the paper average output temperature.

When the paper is heated by the fuser belt, the heat supplied from the fuser belt to the paper, $\dot{Q}_{paper}$, is approximately equal to:

$$\dot{Q}_{paper}\approx\frac{(\overline{T}_{belt}-\overline{T}_{paper})}{R_{belt_paper}}, \tag{3}$$

where $\overline{T}_{belt}$ is the average fuser belt temperature within the nip, $\overline{T}_{paper}$ is the average paper temperature within the nip, and $R_{belt\text{-}paper}$ is the thermal resistance between the fuser belt and the paper.

When the paper enters the nip at a pre-heat temperature that exceeds $T_{amb}$ by an amount $\Delta T$, the amount of heat effective to heat the pre-heated paper to the toner fusing temperature, $T_{paper_out}$, is reduced by an amount equal to the product $\dot{m}_{paper}Cp_{paper}\Delta T$, as follows:

$$\dot{Q}_{paper} = \dot{m}_{paper}Cp_{paper}(T_{paper_out} - (T_{amb} + \Delta T)) = \dot{m}_{paper}Cp_{paper}(T_{paper_out} - T_{amb}) - \dot{m}_{paper}Cp_{paper}\Delta T. \quad (4)$$

By pre-heating the paper to a temperature above ambient temperature, a lower average belt fusing temperature, $\overline{T}'_{belt}$, can be used to heat the paper to the toner fusing temperature. $\overline{T}'_{belt}$ is approximated as follows:

$$\overline{T}'_{belt} \approx \overline{T}_{belt} - \frac{\Delta T}{2}(2R_{belt_paper}\dot{m}_{paper}Cp_{paper} - 1). \quad (5)$$

When the paper is pre-heated by direct convection (such as with the fuser assembly 800 shown in FIG. 2), hot air at a temperature, $T_{hot_air}$, heats the paper and exits warm ($T_{warm_air}$). It can be estimated that an average air temperature, $\overline{T}_{preheat_air}$, heats the paper:

$$\dot{Q}_{preheat} \approx \alpha_{preheat}A_{preheat}(\overline{T}_{preheat_air} - (T_{amb} + \Delta T/2)), \quad (6)$$

where $\alpha_{preheat}$ is the convective heat transfer coefficient between the pre-heat air and the paper.

When the hot air used to pre-heat the paper is supplied from the insulated enclosure containing the belt fuser, the air is heated inside of the enclosure as follows:

$$\dot{m}_{air}Cp_{air}(T_{hot_air} - T_{warm_air}) = \alpha_{cavity}A_{belt}(T'_{belt} - \overline{T}_{preheat_air}), \quad (7)$$

where $\alpha_{cavity}$ is the convective heat transfer coefficient between the fuser belt and the air in the insulated enclosure.

By heating the paper by conduction (i.e., by contact between the heated conveyor belt and the paper) instead of by convection (i.e., by flowing hot air over the paper), the thermal efficiency of the pre-heating process is significantly increased. Also, by using a heat exchanger with a large amount of convective heat transfer surface area (such as a heat exchanger including fins), lower hot air temperatures and lower hot air flow rates can be used to heat the heat exchanger to a temperature effective to heat the paper, as compared to convectively heating the paper by flowing hot air over it:

$$\dot{Q}_{preheat} = \frac{(\overline{T}_{preheat_air} - (T_{amb} + \Delta T/2))}{\frac{1}{\alpha_{fins}A_{fins}} + R_{fins_belt} + R_{belt_paper}} - \dot{Q}_{belt_loss}, \quad (8)$$

where $\alpha_{fins}$ is the convective heat transfer coefficient between the fins and the hot air, $R_{fins_belt}$ is the thermal resistance between the fins and the conveyor belt, and $R_{belt_paper}$ is the thermal resistance between the conveyor belt and the paper.

As $\alpha_{fins}A_{fins} >> \alpha_{preheat}A_{preheat}$, and $$R_{fins_belt} + R_{belt_paper} \ll \frac{1}{\alpha_{fins}A_{fins}},$$

then the equivalent thermal resistance to heat paper by conduction, $R_{eq_conduction}$, compares to the equivalent thermal resistance to heat paper by convection, $R_{eq_convection}$, as follows:

$$R_{eq_conduction} = \frac{1}{\frac{1}{\alpha_{fins}A_{fins}} + R_{fins_belt} + R_{belt_paper}} \ll \frac{1}{\frac{1}{\alpha_{preheat}A_{preheat}}} = R_{eq_convection} \quad (9)$$

According to Equation (9), there is a significantly lower thermal resistance for pre-heating paper when using an embodiment of the fuser assembly constructed to heat the paper by conduction (e.g., the embodiment shown in FIG. 4), as compared to using an embodiment of the fuser assembly that is constructed to heat the paper by convection by blowing hot air onto the paper (e.g., the embodiment shown in FIG. 2). Accordingly, embodiments of the fuser assembly that pre-heat support sheets by conduction can provide still higher energy efficiency.

EXAMPLES

The Table below shows calculated energy consumption and efficiency values: (i) using a fuser assembly without pre-heating capabilities for pre-heating a support sheet, and (ii) using a fuser assembly to conductively pre-heat a support sheet with a heated conveyor belt, such as the embodiment of the fuser assembly shown in FIG. 4. A thermal balance was determined using equations (1) through (8) for cases (i) and (ii). For the calculations, the fuser belt was assumed to be heated by lamps inside the heating rolls.

As shown in the Table, the amount of power consumed by the lamps to heat the fuser belt to a temperature effective to fuse toner on the support sheet can be reduced significantly by pre-heating the support sheet with a pre-heater before fusing the toner at a nip. Consequently, the total power consumption by the fuser assembly including the pre-heater is significantly lower as compared to a fuser assembly without pre-heating capabilities.

The energy efficiency, E, of the respective fuser assemblies used for the fusing processes with and without pre-heating can be expressed as: E=(1−((pre-heat blower power consumption+heat loss)/total power consumption)). As shown in the Table, the energy efficiency using pre-heating is significantly higher than the energy efficiency without using pre-heating. More particularly, the fuser assembly power consumption is reduced by about 35% (i.e., 5138 W−3380W/5138 W) by using pre-heating of the paper, and the energy efficiency, E, is increased from about 53% to 86%.

TABLE

| | Without Pre-heating [W] | With Pre-heating [W] |
|---|---|---|
| Fuser Lamps Power Consumption | 5138 | 3380 |
| Pre-heat Blower Power Consumption | 0 | 150 |
| Total Power Consumption | 5138 | 3530 |
| Pre-heating Power Consumption | 0 | 900 |
| Heat Loss | 2438 | 350 |
| Efficiency | 53% | 86% |

Figure 5:
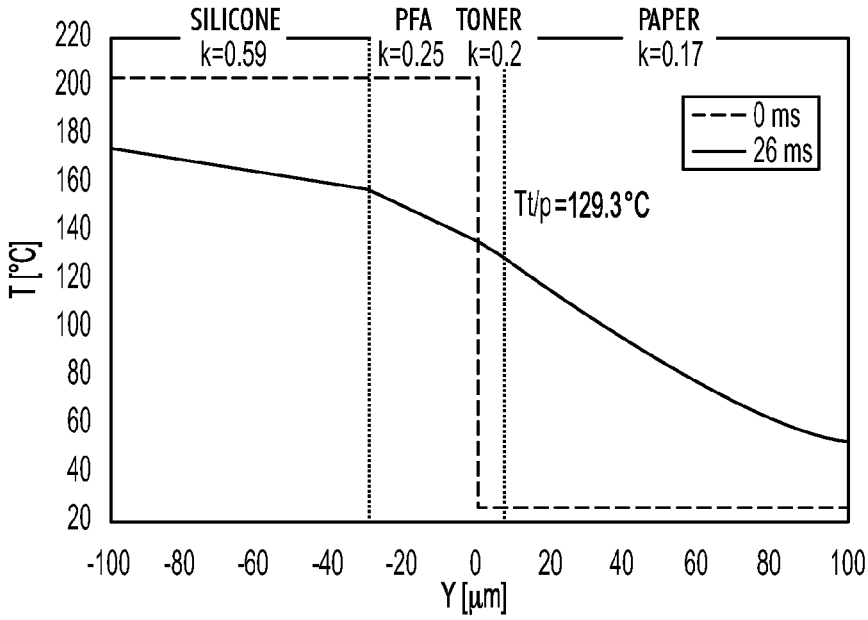
FIG. 5 shows a calculated isothermal temperature versus distance profile for the nip region of a fuser assembly at a fuser belt temperature of 204° C. without pre-heating of a support sheet.

Additional calculations demonstrate that by pre-heating the paper prior to fusing toner on the paper, the fuser belt can be operated at a lower temperature set point to heat the paper to a selected toner fusing temperature as compared to fusing the toner without pre-heating the paper. The calculations are for a fuser assembly without pre-heating and a fuser assembly including a pre-heater for conductively heating the paper (such as shown in FIG. 4). In the calculations, the fuser belt includes an outermost layer of perfluoroalkoxy (PFA) and an adjacent underlying layer of silicone. The paper includes toner on its outer surface. The k (thermal conductivity) values for the different materials used in the calculations are shown in FIG. 5. FIG. 5 shows a temperature versus distance (Y) curve at the nip region using a 702 mm/s process speed and a 26 ms dwell time for a fuser assembly including a fuser belt at a temperature set point of 204° C. with the paper entering at an ambient temperature of 25° C. (i.e., without pre-heating of the paper). A curve is also shown in FIG. 5 for a dwell time of 0 ms (i.e., immediately before the fuser belt and paper came into contact). As indicated in FIG. 5, the temperature, $T_{t/f}$, reached at the toner/fuser belt interface is 129.3° C.

Figure 6:
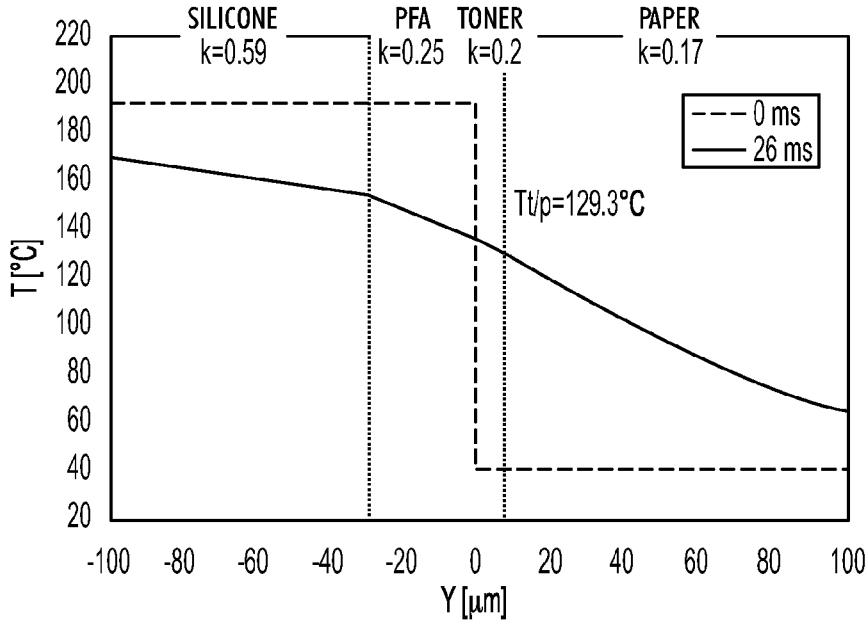
FIG. 6 shows a calculated isothermal temperature versus distance profile for the nip region of a fuser assembly at a fuser belt temperature of 192° C. for a support sheet pre-heated to a temperature of 40° C.

FIG. 6 shows a temperature versus distance curve at the nip region using the same 702 mm/s process speed and 26 ms dwell time for a fuser assembly including a continuous fuser belt with a length of 1 m and having a pre-heater for conductively pre-heating the paper (such as the fuser assembly 900). A curve is also shown for a dwell time of 0 ms. As shown in FIG. 6, the paper and fuser belt structures and materials are the same as those used for the example of FIG. 5. In the example shown in FIG. 6, the paper is pre-heated to a temperature of 40° C. FIG. 6 demonstrates that by pre-heating the paper, a lower fuser belt temperature of 192° C. can be used to heat the toner to the same temperature of 129.3° C. By pre-heating the paper, a significant increase in energy efficiency and reduction in energy consumption by the fuser assembly can be achieved.

It will be appreciated that various ones of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims.

What is claimed is:

1. A fuser assembly for fusing toner onto a support sheet, comprising:
- a heated fuser belt;
- a thermally-insulated enclosure surrounding at least a portion of the heated fuser belt;
- a conveyor for conveying the support sheet to a nip at which the heated fuser belt contacts the support sheet and the toner is fused onto the support sheet;
- a pre-heater; and
- a heat transfer system for transferring heat from inside of the thermally-insulated enclosure to the pre-heater, the pre-heater using the heat to pre-heat the support sheet before the support sheet is conveyed to the nip.

2. The fuser assembly of claim 1, further comprising:
- a fuser roll; and
- a pressure roll;
- wherein:
  - at least one of the fuser roll and pressure roll is heated;
  - the nip is located between the heated fuser belt and the pressure roll;
  - the conveyor comprises a conveyor belt for conveying the support sheet to the nip; and
  - the pre-heater uses the heat to pre-heat the support sheet conveyed by the conveyor belt before the support sheet enters the nip.

3. The fuser assembly of claim 1, wherein the heat transfer system comprises:
- a thermally-insulated flow passage in fluid communication with the thermally-insulated enclosure and the pre-heater; and
- a blower for circulating the hot air from inside of the enclosure to the pre-heater through the flow passage and for re-circulating ambient air into an open end of the thermally-insulated enclosure.

4. The fuser assembly of claim 3, wherein the pre-heater applies the hot air to the support sheet to heat the support sheet by convection.

5. The fuser assembly of claim 4, wherein the pre-heater comprises a porous gas distribution member arranged to distribute the hot air onto the support sheet.

6. The fuser assembly of claim 4, wherein:
- the conveyor comprises a conveyor belt for conveying the support sheet to the nip; and
- the pre-heater comprises a heat exchanger heated by the hot air circulated from the enclosure, the heat exchanger including a heating member for conductively heating the conveyor belt, which conductively heats the support sheet.

7. An electrophotographic apparatus comprising a fuser assembly according to claim 1.

8. A fuser assembly for fusing toner onto a support sheet, comprising:
- an endless heated fuser belt;
- a thermally-insulated enclosure surrounding at least a portion of the heated fuser belt;
- a conveyor including an endless conveyor belt for conveying the support sheet to a nip at which the heated fuser belt contacts the support sheet and the toner is fused onto the support sheet;
- a pre-heater; and
- an air circulation system for circulating hot air from inside of the thermally-insulated enclosure to the pre-heater,
- wherein the pre-heater comprises a heat exchanger heated by the hot air circulated from the thermally-insulated enclosure, the heat exchanger including a heating member for conductively heating the conveyor belt to pre-heat the support sheet before the support sheet is conveyed to the nip.

9. The fuser assembly of claim 8, further comprising:
- a fuser roll; and
- a pressure roll;
- wherein:
  - the nip is located between opposed surfaces of the fuser roll and pressure roll;
  - at least one of the fuser roll and pressure roll is heated; and
  - the heated fuser belt is looped around the fuser roll.

10. The fuser assembly of claim 8, wherein the heated fuser belt has a length of about 350 mm to at least about 1000 mm.

11. The fuser assembly of claim 8, wherein the air circulating system comprises:
- a thermally-insulated first flow passage in fluid communication with the enclosure and the pre-heater; and
- a blower for circulating the hot air from the enclosure to the pre-heater through the thermally-insulated first flow passage and for re-circulating ambient air through an open end of the enclosure via a thermally-insulated second flow passage in fluid communication with the pre-heater and the enclosure.

12. The fuser assembly of claim 8, wherein:

the conveyor belt has a width; and the heating member is sized to heat the conveyor belt across the entire width, wherein the heating member is movable toward and away from the conveyor belt to control the amount of heat applied to the conveyor belt by the heating member.

13. An electrophotographic apparatus comprising a fuser assembly according to claim 8.

14. A method of fusing toner onto a support sheet having toner thereon, comprising:

containing heat emanated by a heated fuser belt within a thermally-insulated enclosure at least partially surrounding the heated fuser belt;

transferring heat from inside of the thermally-insulated enclosure to a pre-heater;

pre-heating a first support sheet supported on a conveyor with the pre-heater using heat transferred from the thermally-insulated enclosure; and conveying the pre-heated first support sheet on the conveyor to a nip and fusing the toner onto the first support sheet.

15. The method of claim 14, further comprising:

circulating hot air from within the thermally-insulated enclosure to the pre-heater through a flow passage; and re-circulating ambient air into the thermally-insulated enclosure through an open end of the thermally-insulated enclosure.

16. The method of claim 15, wherein the pre-heater directs the hot air onto the first support sheet to convectively heat the first support sheet.

17. The method of claim 16, wherein the pre-heater comprises a porous member adjacent the conveyor through which the hot air is distributed onto the first support sheet.

18. The method of claim 15, wherein:

the conveyor comprises a conveyor belt which conveys the first support sheet to the nip; and the pre-heater comprises a heat exchanger which is heated by the hot air from the thermally-insulated enclosure and conductively heats the conveyor belt to pre-heat the first support sheet.

19. The method of claim 18, wherein:

the conveyor belt has a width;

the pre-heating comprises heating the entire width of the conveyor belt with the heat exchanger; and the method further comprises controlling the amount of heat supplied by the heat exchanger to the conveyor belt by controlling the distance between the heat exchanger and the conveyor belt.

20. The method of claim 14, further comprising:

conveying a second support sheet supported on the conveyor to the nip and fusing the toner onto the support sheet without pre-heating the second support sheet, wherein the second support sheet is thinner than the first support sheet; and heating the fuser belt to about the same temperature to fuse the toner on the first support sheet and second support sheet.

* * * * *